US008355652B2

(12) United States Patent
Nakamura et al.

(10) Patent No.: US 8,355,652 B2
(45) Date of Patent: Jan. 15, 2013

(54) DEVELOPMENT CARTRIDGE AND IMAGE FORMING APPARATUS

(75) Inventors: Yuuki Nakamura, Mishima (JP); Shigeo Miyabe, Numazu (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 319 days.

(21) Appl. No.: 12/912,588

(22) Filed: Oct. 26, 2010

(65) Prior Publication Data

US 2011/0103833 A1 May 5, 2011

(30) Foreign Application Priority Data

Oct. 30, 2009 (JP) ..... 2009-249748

(51) Int. Cl.
*G03G 15/08* (2006.01)

(52) U.S. Cl. ..... 399/119; 399/222; 399/227

(58) Field of Classification Search ..... 399/119, 399/222, 227, 263
See application file for complete search history.

(56) References Cited

U.S. PATENT DOCUMENTS

| | | | | |
|---|---|---|---|---|
| 4,792,825 | A * | 12/1988 | Saito et al. | 399/227 |
| 6,983,115 | B2 * | 1/2006 | Isobe et al. | 399/119 |
| 7,885,554 | B2 * | 2/2011 | Shirokoshi et al. | 399/12 |
| 2005/0191091 | A1 | 9/2005 | Isobe | |

FOREIGN PATENT DOCUMENTS

| | | | |
|---|---|---|---|
| EP | 1403735 | A | 3/2004 |
| JP | 2001-075328 | A | 3/2001 |
| JP | 2004-125956 | A | 4/2004 |

* cited by examiner

*Primary Examiner* — Walter L Lindsay, Jr.
*Assistant Examiner* — Roy Y Yi
(74) *Attorney, Agent, or Firm* — Canon USA Inc IP Division

(57) ABSTRACT

An image forming apparatus includes an image bearing member, a plurality of development cartridges each having a developer bearing member bearing a developer for developing an electrostatic image and a developer container accommodating the developer, a rotary configured to rotate and move the attached development cartridges toward a development position, an opening defined in an apparatus main body and allowing the development cartridge to pass through for attachment and detachment to and from the rotary, and an indicator provided on a second development cartridge arranged adjacent to a first development cartridge passing through the opening and detached from the rotary being stopped, wherein the indicator indicates an attachment method usable to attach the first development cartridge to the rotary, and wherein the indicator is located at such a position on the second development cartridge as to be visible from outside of the apparatus main body via the opening.

11 Claims, 10 Drawing Sheets

DEVELOPMENT CARTRIDGE AND IMAGE FORMING APPARATUS

BACKGROUND OF THE INVENTION

1. Field of the Invention

The present invention relates to a development cartridge for developing a latent image formed on an image bearing member by using a developer, and to an image forming apparatus in which a plurality of development cartridges are detachably attached to a rotary.

Here, an image forming apparatus is an apparatus forming an image on a recording medium by using an electrophotographic image forming process. Examples of the electrophotographic image forming apparatus include an electrophotographic copying machine, an electrophotographic printer (light emitting diode (LED) printer, a laser beam printer, or the like), an electrophotographic facsimile apparatus, and an electrophotographic word processor.

A recording medium is a medium on which an image is formed by an electrophotographic image forming apparatus; examples of the recording medium include a paper sheet and an Over Head Projector (OHP) sheet.

A development cartridge is a cartridge which has a developer bearing member and a developer container for developing a latent image formed on an image bearing member such as an electrophotographic photosensitive member by using a developer and which is detachably attached to a rotary rotatably provided in the apparatus main body of an electrophotographic image forming apparatus.

2. Description of the Related Art

In recent years, the demand for a color electrophotographic image forming apparatus capable of color image formation has increased, and the introduction of an inexpensive color electrophotographic image forming apparatus, more specifically, one whose price is low enough to be purchased by a general user, is expected. To realize such an inexpensive color electrophotographic image forming apparatus, a further reduction in the size of a color electrophotographic image forming apparatus is required.

In view of this, as discussed in Japanese Patent Application Laid-Open No. 2001-75328 and Japanese Patent Application Laid-Open No. 2004-125956, there has been proposed a rotary type color electrophotographic image forming apparatus equipped with a rotary allowing mounting of a plurality of development cartridges. In this color electrophotographic image forming apparatus, the rotary is rotatably provided in the apparatus main body of the electrophotographic image forming apparatus to switch each development cartridge to a development position where it is opposite to the electrophotographic photosensitive member. Further, the development cartridge has a development roller for developing a latent image formed on the electrophotographic photosensitive member by using the toner contained, and is detachably attached to the rotary.

Regarding this rotary type color electrophotographic image forming apparatus, there has been discussed a construction in which a cover in the apparatus upper surface is opened to perform the attachment and detachment of the development cartridge from above. Further, Japanese Patent Application Laid-Open No. 2001-75328 discusses a construction in which, in order to achieve an improvement in terms of the operability at the time of attachment of the development cartridge, each development cartridge is provided with an identification indicator indicating, at a position visible from above, the color of the toner contained and the direction in which the attachment to the rotary is to be effected. Further, Japanese Patent Application Laid-Open No. 2001-75328 discusses a construction in which the detachment of the development cartridge from the rotary is only possible in a state in which the identification indicator is directed upwards. More specifically, the identification indicator is provided on the surface of the development cartridge attached to the rotary directed outwards in the radial direction of the rotary.

In the above related-art example, through the rotation of the rotary, the development cartridges mounted on the rotary are successively switched to the development position where they are opposite to the electrophotographic photosensitive member, and the development roller and the electrophotographic photosensitive member are opposite to each other to effect development with the toner of each color. More specifically, the development roller is arranged on the surface of the development cartridge where the identification indicator is provided, for example, on the surface directed outwards in the radial direction of the rotary. Further, generally speaking, in a development cartridge, on the surface where the development roller is arranged, there are arranged, not only the development roller, but also a layer thickness regulating member regulating the thickness of the toner layer on the development roller, a scattering prevention member preventing scattering of toner, a grip portion for replacing the cartridge, etc. Thus, to achieve a further reduction in size while maintaining the improved operability at the time of replacement of the development cartridge, it is rather difficult to provide the identification indicator on the surface where the development roller is arranged.

SUMMARY OF THE INVENTION

The present invention is directed to an image forming apparatus equipped with a rotary on which a plurality of development cartridges are mounted, wherein there are realized both an improvement in terms of operability at the time of replacement of the development cartridges and a further reduction in size of the development cartridges.

According to an aspect of the present invention, an image forming apparatus includes an image bearing member on which is formed an electrostatic image, a plurality of development cartridges each including a developer bearing member configured to bear a developer for developing the electrostatic image and a developer container configured to accommodate the developer, a rotary, to which the plurality of development cartridges are detachably attached, configured to rotate and move the attached development cartridges toward a development position where the electrostatic image is developed, an opening defined in a main body of the image forming apparatus and allowing the development cartridge to pass therethrough for attachment and detachment to and from the rotary, and an indicator provided on a second development cartridge arranged adjacent to a first development cartridge passing through the opening and detached from the rotary being stopped, wherein the indicator indicates an attachment method, an attachment procedure, or a handling method usable to attach the first development cartridge to the rotary, and wherein the indicator is located at such a position on the second development cartridge as to be visible from outside of the main body via the opening with the first development cartridge detached.

According to another aspect of the present invention, an image forming apparatus includes an image bearing member on which is formed an electrostatic image, a plurality of development cartridges each including a developer bearing member configured to bear a developer for developing the electrostatic image and a developer container configured to accommodate the developer, a rotary, to which the plurality of development cartridges are detachably attached, configured to rotate and move the attached development cartridges toward a development position where the electrostatic image is developed, a partition portion provided on the rotary and arranged between the plurality of development cartridges attached to the rotary, an opening defined in a main body of the image forming apparatus and allowing the development cartridge to pass therethrough for attachment and detachment to and from the rotary, and an indicator provided on the partition portion arranged adjacent to a first development cartridge passing through the opening and detached from the rotary being stopped, wherein the indicator indicates an attachment method, an attachment procedure, or a handling method usable to attach the first development cartridge to the rotary, and wherein the indicator is located at such a position on the partition portion as to be visible from outside of the main body via the opening with the first development cartridge detached.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
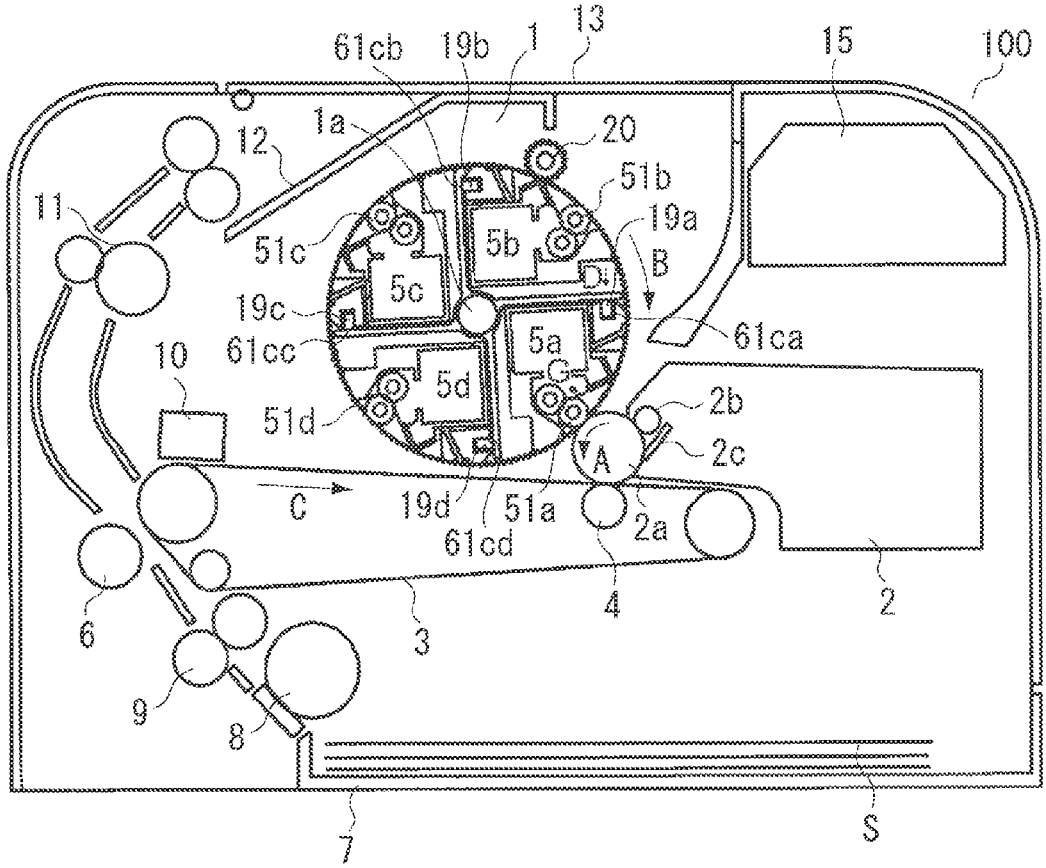
FIG. 1 is a schematic sectional view of the configuration of an image forming apparatus according to a first exemplary embodiment of the present invention during development.
Figure 2:
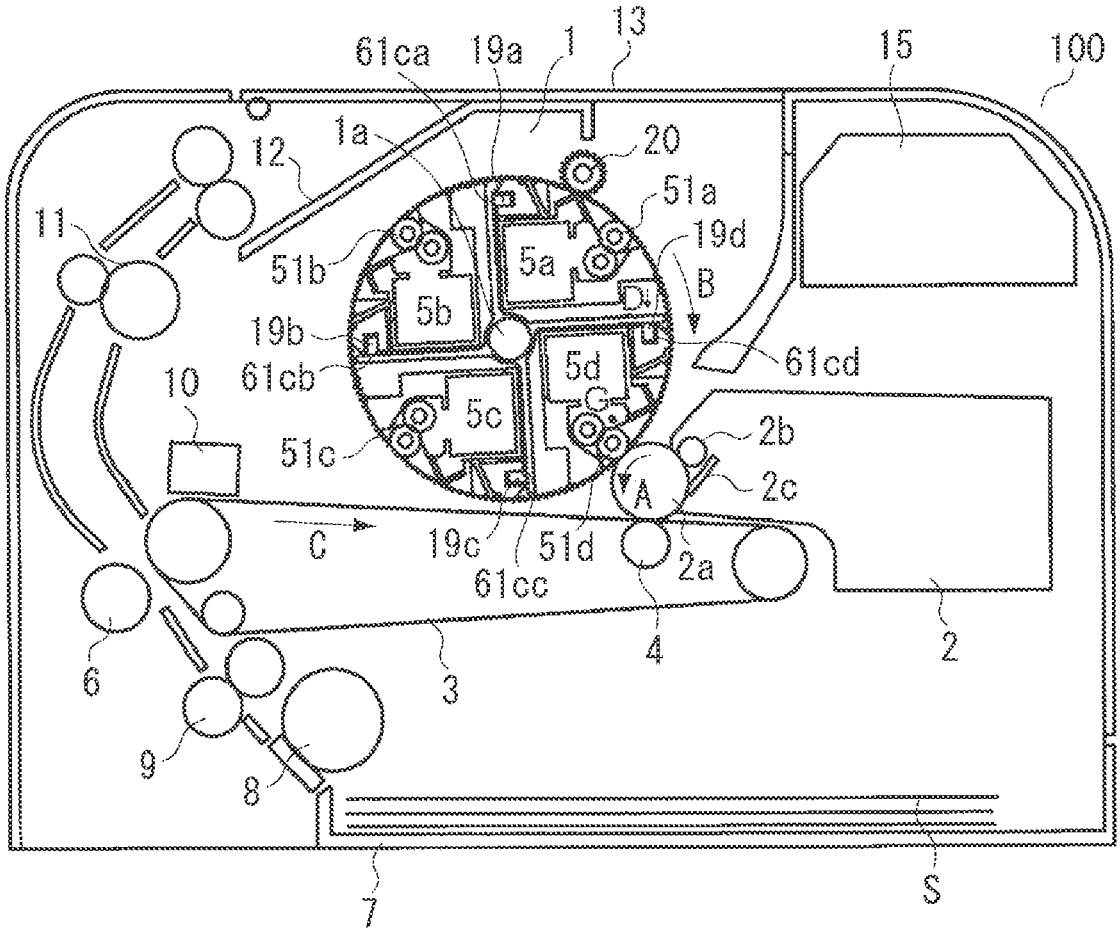
FIG. 2 is a schematic sectional view of the configuration of the image forming apparatus according to the first exemplary embodiment during development.

A color electrophotographic image forming apparatus according to a first exemplary embodiment of the present invention (hereinafter referred to as the image forming apparatus) is a full color laser beam printer of four colors. FIG. 1 is a schematic sectional view illustrating its configuration when a yellow development cartridge 5*a* is performing a developing operation. FIG. 2 is a schematic sectional view illustrating its configuration when a black development cartridge 5*d* is performing a developing operation.

As illustrated in FIG. 1, an apparatus main body 100 of the image forming apparatus has a photosensitive drum 2*a* as an image bearing member (electrophotographic photosensitive member). Around the photosensitive drum 2*a*, there are arranged a charging unit 2*b*, an exposure unit 15, a rotary 1 to which a plurality of development cartridges are detachably attached, and a cleaning unit 2*c*. The charging unit 2*b* serves to uniformly charge the photosensitive drum 2*a*; here, a charging roller is adopted as the charging unit. The exposure unit 15 serves to apply a laser beam onto the photosensitive drum 2*a* to form a latent image. The cleaning unit 2*c* serves to remove residual toner on the photosensitive drum 2*a*. Here, there is adopted a drum cartridge 2 in which the photosensitive drum 2*a*, the charging unit 2*b*, and the cleaning unit 2*c* are formed integrally, and which is detachable with respect to the apparatus main body 100. The photosensitive drum 2*a*, the charging unit 2*b*, and the cleaning unit 2*c* may be of an independent construction or may be integrated with each other.

The rotary 1 is rotatably provided in the apparatus main body 100, and a plurality of development cartridges 5*a*, 5*b*, 5*c*, and 5*d* are detachably attached thereto. While retaining the plurality of development cartridges 5*a*, 5*b*, 5*c*, and 5*d* detachably attached thereto, the rotary 1 conveys them one by one to a development position for developing a latent image formed on the photosensitive drum 2*a*. Here, there are illustrated, by way of example, as the development cartridges, a yellow development cartridge 5*a*, a magenta development cartridge 5*b*, a cyan development cartridge 5*c*, and a black development cartridge 5*d*. The rotary 1 retains the yellow development cartridge 5*a*, the magenta development cartridge 5*b*, the cyan development cartridge 5*c*, and the black development cartridge 5*d* at equal intervals. All of the yellow development cartridge 5*a*, the magenta development cartridge 5*b*, the cyan development cartridge 5*c*, and the black development cartridge 5*d* are retained by the rotary 1 by virtue of the same construction.

Thus, here, to illustrate how the yellow development cartridge 5*a*, the magenta development cartridge 5*b*, the cyan development cartridge 5*c*, and the black development cartridge 5*d* are retained by the rotary 1, it will be illustrated how the yellow development cartridge 5*a* is retained.

The yellow development cartridge 5*a* is attached to the rotary 1, and a locked portion 61*ca* provided on the yellow development cartridge 5*a* is engaged with a development cartridge lock member 19*a* provided on the rotary 1, whereby detachment of the development cartridge from the rotary 1 is suppressed. The development cartridge lock member 19*a* is urged (in the direction of the arrow D) by a spring (not illustrated) so as to be engaged with the yellow development cartridge 5*a*. The magenta development cartridge 5*b*, the cyan development cartridge 5*c*, and the black development cartridge 5*d* are respectively provided with locked portions 61*cb*,

61*cc*, and 61*cd*, which are respectively engaged with development cartridge lock members 19*b*, 19*c*, and 19*d*, whereby their detachment from the rotary 1 is suppressed.

Here, the image forming operation of the above-described image forming apparatus will be illustrated. First, the photosensitive drum 2*a* is rotated in the direction of the arrow A in FIG. 1 in synchronization with the rotation in the direction of the arrow C of an intermediate transfer belt 3. Then, the surface of the photosensitive drum 2*a* is uniformly charged by the charging unit 2*b*, and a yellow image is irradiated with light by the exposure unit 15, whereby a yellow electrostatic latent image is formed on the photosensitive drum 2*a*.

Simultaneously with the formation of this electrostatic latent image, the rotary 1 retaining the development cartridges 5*a*, 5*b*, 5*c*, and 5*d* and rotatable, is rotated in the direction of the arrow B in FIG. 1 by a drive transmission mechanism provided in the apparatus main body 100. As a result, the rotary 1 rotates, and the yellow development cartridge 5*a* is first arranged at the development position where it is opposite to the photosensitive drum 2*a* (See FIG. 1).

Then, a voltage of the same polarity as the charging polarity of the photosensitive drum 2*a* is applied to a development roller 51*a* so that a yellow developer may adhere to the latent image formed on the photosensitive drum 2*a*. As a result, development is effected by causing a developer of the corresponding color (yellow developer) to adhere to the latent image formed on the photosensitive drum 2*a*. More specifically, a yellow developer image is formed on the photosensitive drum 2*a*.

After this, a voltage of a polarity opposite to that of the toner is applied to a primary transfer roller 4 arranged on the inner side of the intermediate transfer belt 3 to effect a primary transfer of the yellow toner image on the photosensitive drum 2*a* onto the intermediate transfer belt 3.

When the primary transfer of the yellow toner image is completed as described above, the rotary 1 receives a drive force from a drive transmission mechanism of the apparatus main body 100 and rotates in the direction of the arrow B in FIG. 1, and the next development cartridge is placed at the development position where it is opposite to the photosensitive drum 2*a*. More specifically, the magenta development cartridge 5*b*, the cyan development cartridge 5*c*, and the black development cartridge 5*d* are successively placed at the development position where they are opposite to the photosensitive drum 2*a*. As in the case of the yellow image, the formation of an electrostatic latent image, development, and primary transfer are successively effected for the colors of magenta, cyan, and black, and toner images of four colors are superimposed one upon the other on the intermediate transfer belt 3.

During this time, as illustrated in FIG. 1, a secondary transfer roller 6 is out of contact with the intermediate transfer belt 3. Further, at this time, a cleaning unit 10 for the intermediate transfer belt 3 is also situated out of contact with the intermediate transfer belt 3.

On the other hand, sheets S, which are objects to which toner images are to be transferred (recording media), are stacked together and accommodated in a feed cassette 7 provided in the lower portion of the apparatus main body 100; the sheets are fed separately one by one from the feed cassette 7 to a registration roller pair 9 by a feed roller 8. Here, as illustrated in FIG. 2, the secondary transfer roller 6 is brought into press contact with the intermediate transfer belt 3.

Further, a voltage of a polarity opposite to that of the toners is applied to the secondary transfer roller 6. The toner images of four colors superimposed one upon the other on the above-mentioned intermediate transfer belt 3 collectively undergo secondary transfer onto the surface of the sheet S conveyed at a secondary transfer position between the intermediate transfer belt 3 and the secondary transfer roller 6.

The sheet S to which the toner images have been transferred is conveyed to a fixing device 11. In the fixing device 11, the sheet S undergoes heating and pressurization, and the toner images are fixed to the sheet S. As a result, an image is formed on the sheet S. The sheet S is discharged from the fixing device 11 onto a discharge portion of an upper cover 12 outside the apparatus.

All of the yellow development cartridge 5*a*, the magenta development cartridge 5*b*, the cyan development cartridge 5*c*, and the black development cartridge 5*d* are of the same construction. Thus, the construction of the yellow development cartridge 5*a*, the magenta development cartridge 5*b*, the cyan development cartridge 5*c*, and the black development cartridge 5*d* will be collectively described as the construction of the development cartridge 5.

Figure 3A:
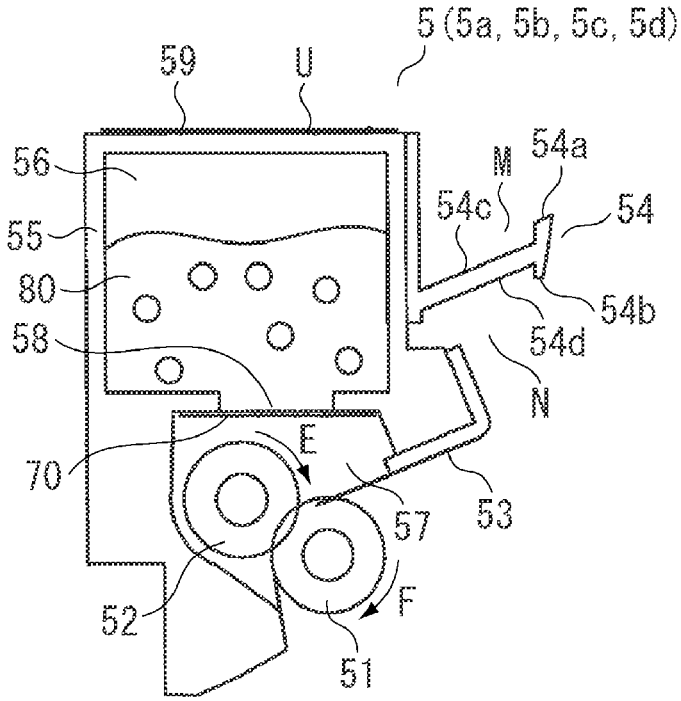
FIGS. 3A and 3B are sectional views of a development cartridge according to the first exemplary embodiment.
Figure 3B:
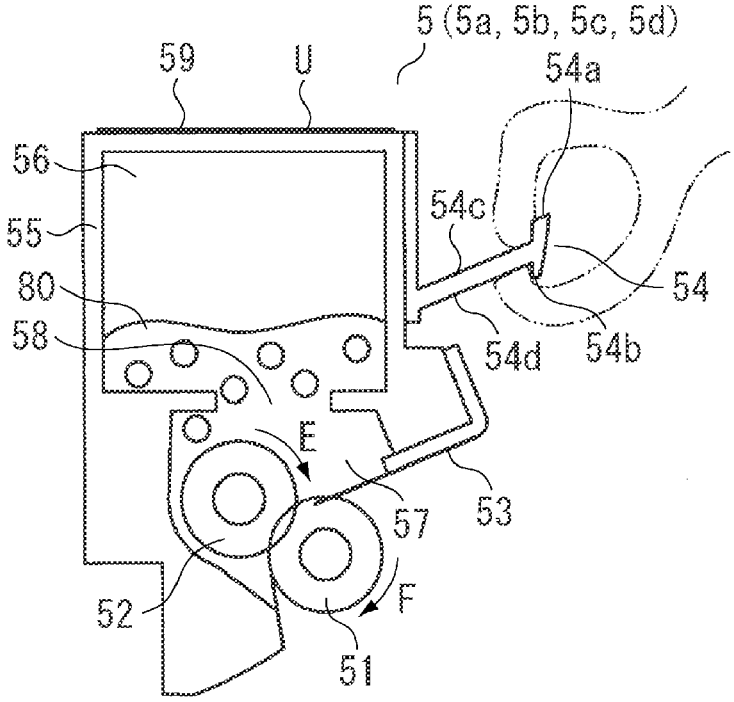

The development cartridge 5 will be described with reference to FIGS. 3A and 3B. FIGS. 3A and 3B are sectional views of a development cartridge. FIG. 3A is a sectional view of the development cartridge 5 according to the present exemplary embodiment prior to removal of a toner seal therefrom, and FIG. 3B is a sectional view of the development cartridge 5 according to the present exemplary embodiment after removal of the toner seal therefrom.

The development cartridge 5 has a development roller 51 as a developer bearing member for developing a latent image formed on the photosensitive drum 2*a* by using a toner (developer), and a development container 55 as a developer container for accommodating the toner. The development container 55 of the development cartridge 5 is divided into a toner accommodating chamber 56 and a development chamber 57 having the development roller 51 and a toner supply roller 52, and the two chambers are separated from each other by a toner supply opening 58.

As illustrated in FIG. 3A, in the unused state of the development cartridge 5, a film-like toner seal 70 for separating the toner accommodating chamber 56 and the development chamber 57 from each other is fixed to the toner supply opening 58 of the development container 55 by a method such as thermal adhesion. By removing the toner seal 70 prior to use, toner 80 in the toner accommodating chamber 56 freely drops into the development chamber 57 at the development position opposite to the photosensitive drum as illustrated in FIG. 3B. The toner in the development chamber 57 is supplied to a toner supply roller 52. Further, the toner supply roller 52 rotates in the direction of the arrow E to thereby supply toner to the development roller 51. The development roller 51 is made of an elastic rubber roller, and rotates in the direction of the arrow F. The toner on the development roller 51 is regulated to a fixed thickness by a development blade 53, and is supplied to the photosensitive drum 2*a* at the development position, with the latent image being developed by the toner.

After the development, the toner left on the development roller 51 is removed by the toner supply roller 52. After this, toner is supplied again to the development roller 51 by the toner supply roller 52.

Further, at the development position, to hold the development roller 51 in contact with the photosensitive drum 2*a* in a stable manner, the entire rotary 1 retaining the development cartridges 5*a*, 5*b*, 5*c*, and 5*d* is urged in the direction of the photosensitive drum 2*a*. As a result, a development roller 51*a* of the yellow development cartridge 5*a* is held in contact with the photosensitive drum 2*a* with a predetermined pressurizing force. At this time, the rotary 1 retaining the yellow development cartridge 5*a*, the magenta development cartridge 5*b*, the cyan development cartridge 5*c*, and the black development cartridge 5*d* is rockable around a rotary drive shaft 20. The entire rotary 1 is pressurized in the direction of the photosensitive drum 2*a* by a pressurization unit (not illustrated), and the development roller of the development cartridge fixed in position at the development position contacts the photosensitive drum 2*a*. In FIG. 1, the development roller 51*a* of the yellow development cartridge 5*a* contacts the photosensitive drum 2*a*, and, in FIG. 2, the development roller 51*d* of the black development cartridge 5*d* contacts the photosensitive drum 2*a*.

Next, the attachment/detachment of the development cartridges with respect to the apparatus main body 100 of the image forming apparatus will be described with reference to FIGS. 5 and 6. The attachment/detachment operation with respect to the apparatus main body 100 and the construction are the same for all of the yellow development cartridge 5*a*, the magenta development cartridge 5*b*, the cyan development cartridge 5*c*, and the black development cartridge 5*d*. Thus, here, the attachment/detachment operation with respect to the apparatus main body and the construction in the case of the yellow development cartridge 5*a* will be described.

Figure 5:
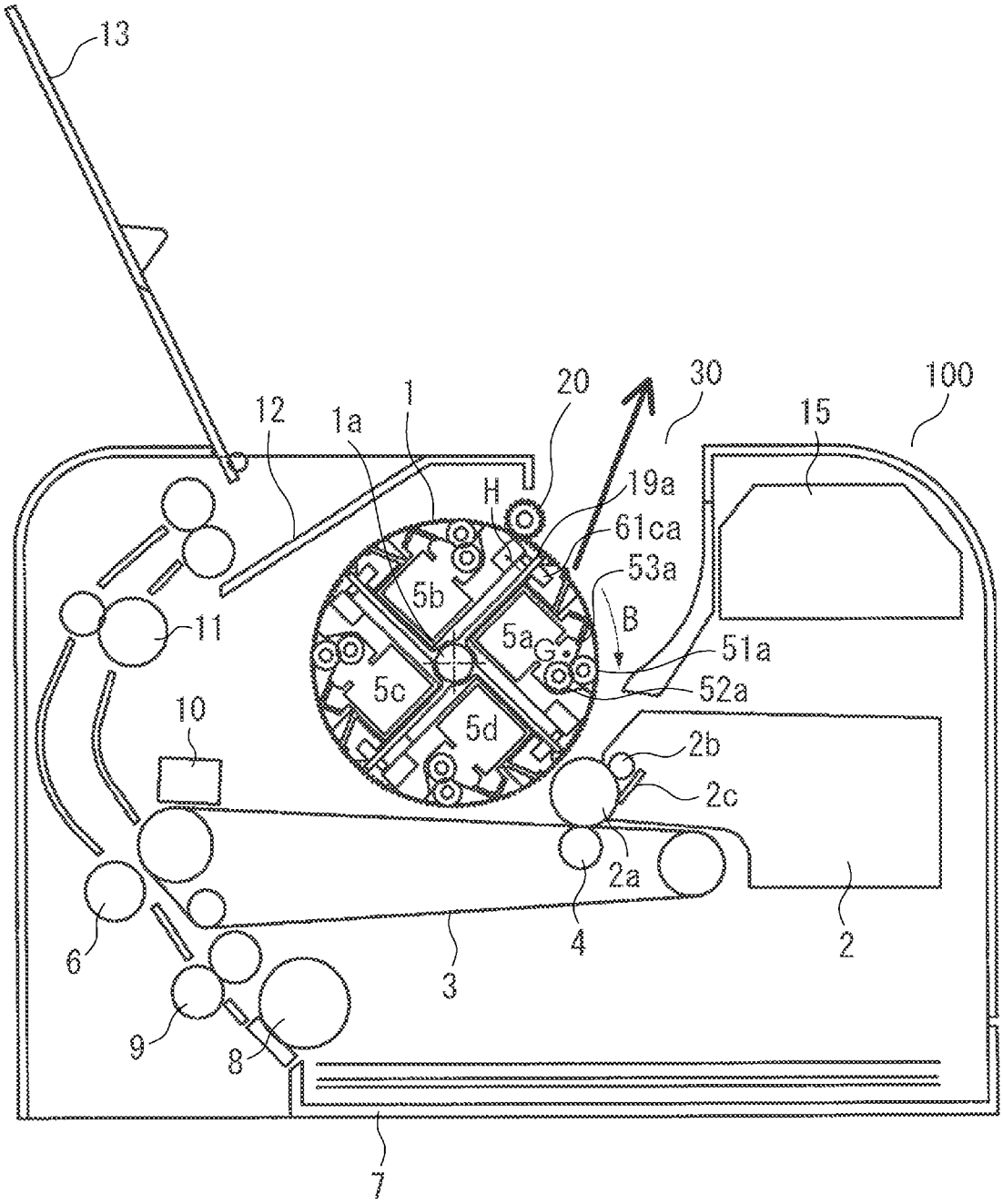
FIG. 5 is a sectional view of the image forming apparatus in a state in which attachment/detachment of the development cartridges is possible.
Figure 6:
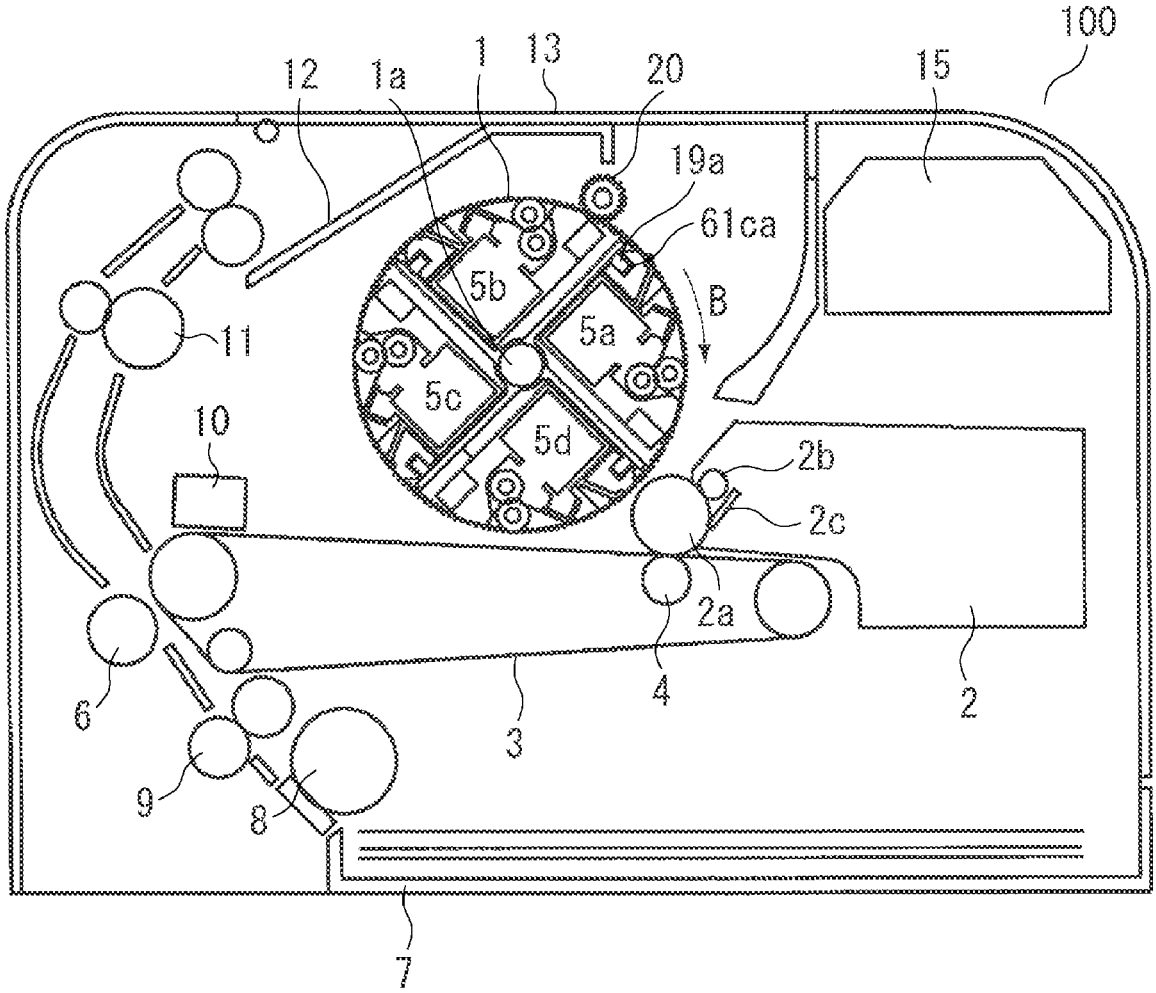
FIG. 6 is a sectional view of the image forming apparatus in a state in which the development cartridges have been attached and in which the apparatus is on standby except for the developing operation.

FIG. 5 is a sectional view of the image forming apparatus main body illustrating the attachment/detachment position when the yellow development cartridge (first development cartridge) 5*a* is attached/detached. FIG. 6 is a sectional view of the image forming apparatus main body illustrating the attachment/detachment position after the yellow development cartridge 5*a* is attached, and is a sectional view of the image forming apparatus main body illustrating the standby state of the development cartridge other than the development operation.

Except during the development operation, the rotary 1 is on standby at a position to which it has been rotated around a rotary rotation shaft 1*a* until a phase is attained where the development roller is separated from the photosensitive drum 2*a*. Here, as illustrated in FIG. 6, in the standby state, the yellow development cartridge 5*a* is upstream by 45° with respect to the rotary rotating direction from the development position. The transition to the standby state is automatically effected by the drive transmission mechanism after the completion of the image forming operation.

Next, the operation of attaching/detaching the development cartridges will be described. As illustrated in FIG. 5, when attaching/detaching the development cartridges (5*a* through 5*d*), an attachment/detachment cover 13 is opened. As a result, an opening 30 which is provided in the apparatus main body 100 and which is passed for attachment/detachment of the development cartridges with respect to the rotary is opened, and the user has access to the development cartridges (5*a* through 5*d*).

The attachment/detachment of the yellow development cartridge 5*a* is effected in the above-mentioned standby state. Similarly, the other development cartridges, i.e., the magenta development cartridge 5*b*, the cyan development cartridge 5*c*, and the black development cartridge 5*d* can be attached/detached at the position (standby position) 45° upstream of the development position with respect to the rotary rotating direction. Through the opening of the attachment/detachment cover 13, the development cartridge lock member 19*a* is retracted in the direction of the arrow H in FIG. 6, and moves to a position where it is not engaged with the locked portion 61*ca* of the development cartridge 5*a*. As a result, solely the yellow development cartridge 5*a* at the attachment/detachment position is brought out of engagement with the rotary 1, enabling the user to perform the attachment/detachment of the development cartridge 5*a*. The movement of each development cartridge to the attachment/detachment position where its attachment/detachment is possible, is effected by the drive transmission mechanism in the apparatus main body or through direct manual movement of the rotary 1. As illustrated in FIG. 6, when the user closes the attachment/detachment cover 13, the development cartridge lock member 19*a* moves in the direction of the arrow D in FIG. 1 to move up to the position where it is engaged with the locked portion 61*ca* of the development cartridge.

Next, the operation of removing the development cartridge with respect to the apparatus main body 100 of the image forming apparatus will be described with reference to FIGS. 3A, 3B, 4, 5, and 7A. All of the yellow development cartridge 5*a*, the magenta development cartridge 5*b*, the cyan development cartridge 5*c*, and the black development cartridge 5*d* are removed from the apparatus main body 100 in the same manner. Thus, here, the manner in which the yellow development cartridge 5*a* is removed from the apparatus main body will be described by way of example.

Figure 4:
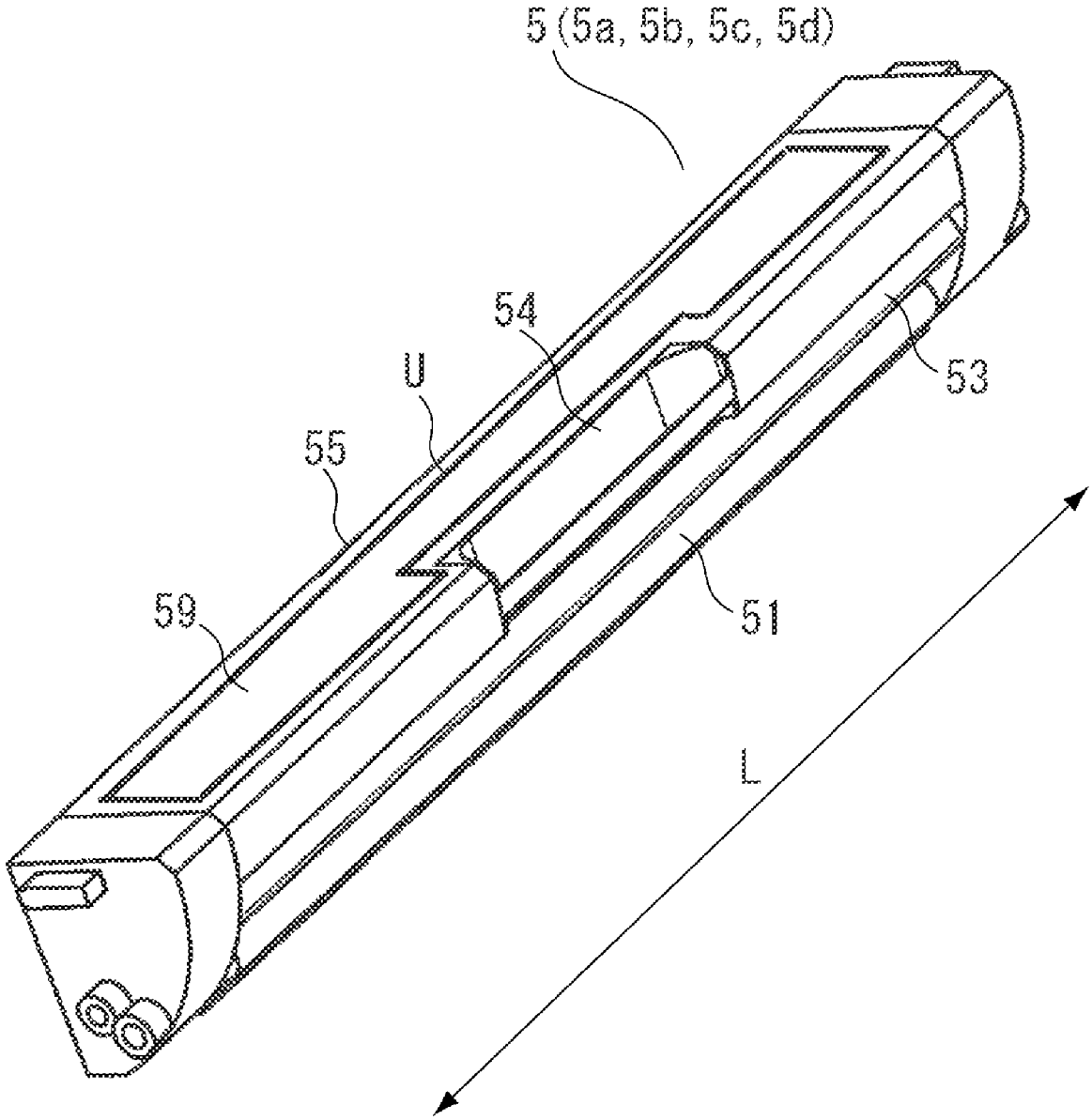
FIG. 4 is a perspective view of the development cartridge according to the first exemplary embodiment.
Figure 7A:
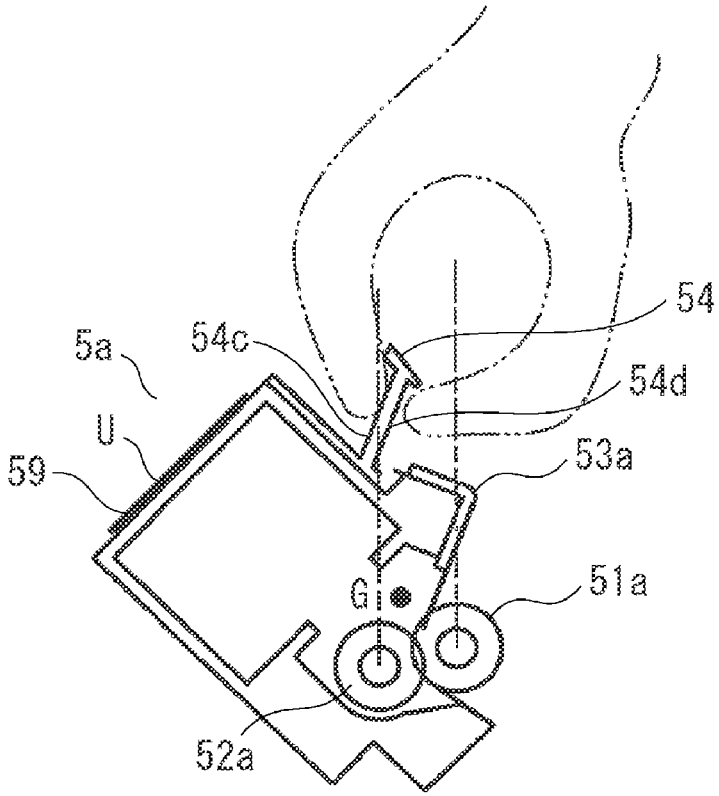
FIG. 7A is a sectional view of the development cartridge when a grip of the development cartridge according to the first exemplary embodiment is grasped.

FIG. 4 is a schematic perspective view of the development cartridge. FIG. 7A is a sectional view of the yellow development cartridge 5*a* when it is attached/detached.

First, a grip 54 of the development cartridge will be described with reference to FIGS. 3A, 3B, and 4. The grip 54 is situated substantially at the center in the longitudinal direction (the direction of the arrow L in FIG. 4) of the development cartridge. As illustrated in FIG. 3A, the grip 54 is formed by vertical protrusions 54*a* and 54*b* at the grip forward end side and slope portions 54*c* and 54*d*. The protrusions 54*a* and 54*b* are steps of a predetermined height (which, here, is approximately 1 to 10 mm), and serve as a hook when grasped by the user. The slope portions 54*c* and 54*d* are the portions actually grasped by the user. The slope portions 54*c* and 54*d* have a surface parallel to the longitudinal axis of the development cartridge 5, and are provided longitudinally in a predetermined length (Here, the longitudinal width is approximately 50 to 150 mm). The protrusions 54*a* and 54*b* are also parallel to the longitudinal axis, and are provided in a predetermined longitudinal length (Here, the longitudinal width is approximately 50 to 150 mm). Spaces M and N existing above and below the slope portions 54*c* and 54*d* constitute the spaces into which fingers of the user are to be inserted. Here, the optimum manner of grasping is to insert the index finger, the middle finger, and the ring finger into the space M and to insert the thumb into the space N, holding the slope portions 54*c* and 54*d* therebetween.

Further, as illustrated in FIG. 5, at the attachment/detachment position of the yellow development cartridge 5*a*, the grasping portion of the grip 54 is situated substantially vertically above the center of gravity G. Here, the center of gravity G is situated in the vicinity of the development roller 51*a*, the toner supply roller 52*a*, and the development blade 53. By providing the grip 54 at the above-mentioned position, the attitude of the yellow development cartridge 5*a* at the attachment/detachment position illustrated in FIG. 5 becomes substantially the same as the attitude of the yellow development cartridge 5*a* illustrated in FIG. 7A when the user removes it from the apparatus main body 100 by grasping the grip 54. Thus, when the user removes the yellow development cartridge 5*a* from the apparatus main body 100, there is no need to perform a complicated operation, and it is possible to easily remove it by grasping the grip 54 and pulling it in the direction of the arrow in FIG. 5, i.e., in the direction of the opening 30.

The operation of attaching the yellow development cartridge 5*a* to the apparatus main body 100 will be described with reference to FIGS. 3A, 3B, 4, 7B, and 8.

Figure 7B:
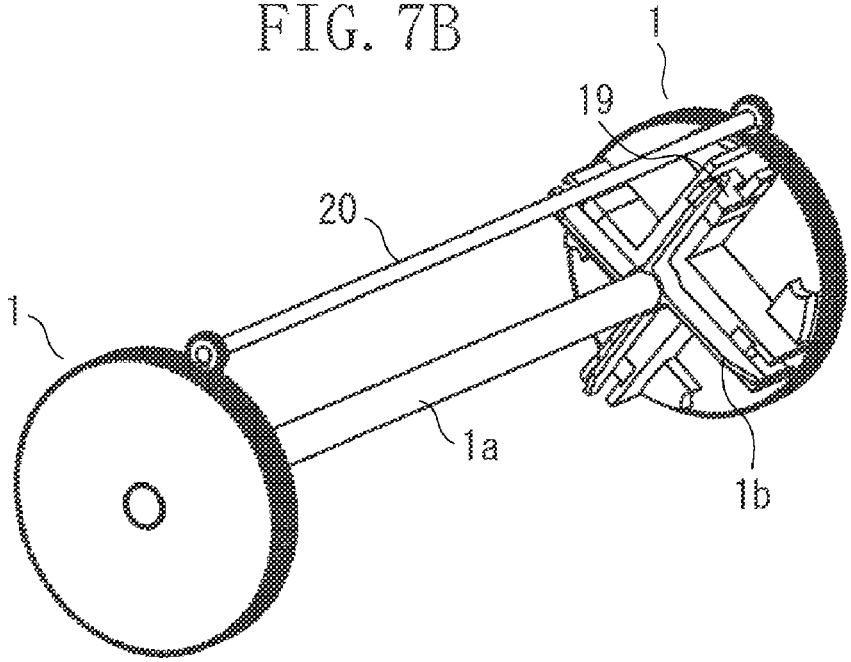
FIG. 7B is a perspective view of a rotary retaining the development cartridges according to the first exemplary embodiment.
Figure 8:
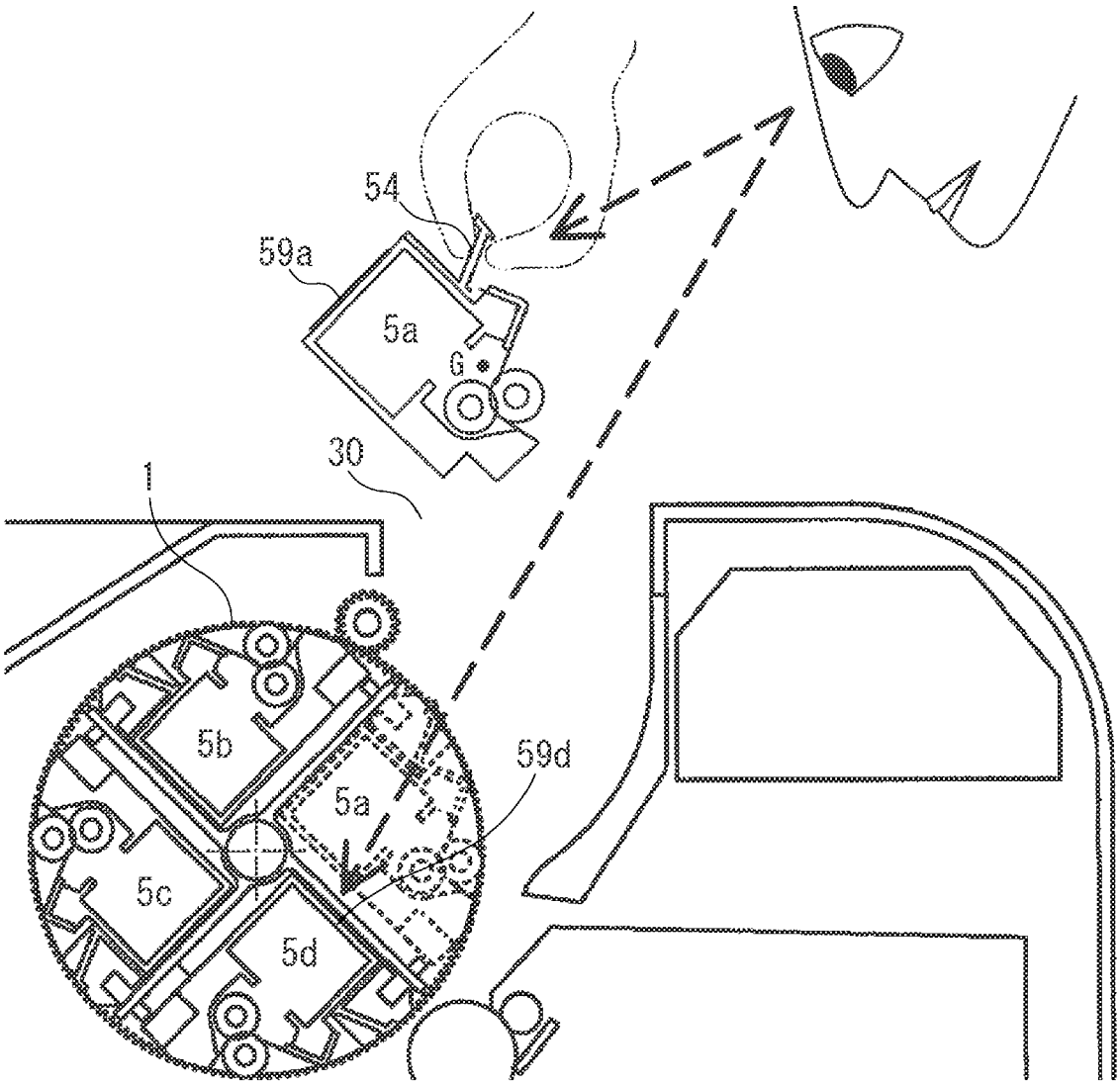
FIG. 8 is a sectional view of the image forming apparatus when the development cartridge according to the first exemplary embodiment is attached to the image forming apparatus main body.

FIG. 7B is a schematic perspective view of the rotary retaining the development cartridges. FIG. 8 is a sectional view of the image forming apparatus main body, illustrating the attachment operation by the user when attaching the yellow development cartridge 5*a*.

First, an attachment operation indication label 59 indicating the development cartridge attachment method will be described with reference to FIGS. 2, 4, 7B, and 8.

The attachment operation indication label (indicator) 59 is an indicator indicating the operation method usable to attach the development cartridge to the rotary (the attachment method or attachment procedure or handling method); here, it is provided on the development cartridge. Here, the operation method refers to a method (attachment method) related to the operation of attaching an unused development cartridge to the rotary. Further, this operation method includes development cartridge handling methods, such as the operation of shaking the unused development cartridge in order to agitate the toner contained, and the operation of removing a toner seal. Further, this operation method also includes the attachment procedures from unpacking the unused development cartridge to the attachment thereof to the rotary.

The attachment operation indication label 59 is attached to a position where, when the development cartridge is removed via the opening 30 from the rotary 1 being stopped, the label 59 provided on the development cartridge (second development cartridge) adjacent to the position to which the removed development cartridge 5*a* has been placed, is visible from outside of the apparatus main body 100 via the opening 30. Here, the attachment operation indication label 59 is provided on a top surface U of the development cartridge.

Further, the attachment operation indication label 59 is provided on the surface where the normal with respect to the indicator is directed to the opening 30, with the development cartridge being situated adjacent to the attachment/detachment position. More specifically, in FIG. 8, the position of the yellow development cartridge (first development cartridge) 5*a* indicated by the dashed line is the above-mentioned attachment/detachment position, whereas the position of the black development cartridge 5*d* (second development cartridge) on the downstream side with respect to the rotating direction of the rotary 1 is the position adjacent to the attachment/detachment position. Here, the term "normal" means a straight line passing a point on the surface where the attachment operation indication label is provided and orthogonal to the tangent to this surface at this point. Further, the above-mentioned normal is not restricted to a straight line orthogonal to the tangent to the surface at the above-mentioned point, but also includes a straight line crossing the tangent within a range in which it is visible via the opening 30 provided in the apparatus main body 100.

Further, the attachment operation indication label 59 is provided on the surface opposite to the adjacent development cartridge. More specifically, in FIG. 8, the attachment operation indication label 59 is provided on the surface (top surface U) of the black development cartridge 5*d* situated at the adjacent position and opposite to the yellow development cartridge 5*a* situated at the attachment/detachment position (indicated by the dashed line).

As illustrated in FIGS. 3A, 3B, and 4, the attachment operation indication label 59 is attached to the top surface U of the development cartridge. Further, as illustrated in FIG. 7B, partition plates 1*b* are mounted solely to both longitudinal ends of the development cartridge 5*a*. Thus, as illustrated in FIG. 8, the attachment operation indication label 59*d* attached to the top surface U of the black development cartridge 5*d* becomes visible from outside of the apparatus main body 100 via the opening 30 by opening the attachment/detachment cover 13 of the apparatus main body 100 and removing the adjacent yellow development cartridge.

As described above, while, in the present exemplary embodiment, the partition plates 1*b* are provided solely at the longitudinal ends of the development cartridge 5*a*, this should not be construed restrictively. For example, if the partition plate extends over the entire longitudinal area of the development cartridge 5*a*, by forming the partition plate 1*b* as a transparent member, the attachment operation indication label 59*d* attached to the top surface U of the black development cartridge 5*d* is visible from outside of the apparatus main body 100 via the opening 30. Further, the surface to which the attachment operation indication label is attached is not necessarily restricted to the top surface U of the development cartridge. The attachment operation indication label may be attached to any surface which is other than the surface on the outer peripheral side in the radial direction of the rotary where the development roller, etc., are arranged and which is visible from the opening 30. Further, of the surface visible from the opening 30, it may be attached to any surface of the development cartridge attached to the rotary and adjacent to the development cartridge that has been removed from the rotary. Further, it is also possible to attach the attachment operation indication labels 59 to a plurality of surfaces satisfying the above-mentioned conditions. Further, while in the present exemplary embodiment a label is attached as the indicator to the top surface U of the development container 55, this should not be construed restrictively; it is also possible to directly inscribe the above operation method on the development container 55 (inscription portion). In the case where a label is used, it is also possible to attain an improvement in terms of recycling property by adopting the same material and facilitating the separation of the label.

Next, the operation when the user actually attaches the development cartridge 5*a* to the apparatus main body 100 will be described with reference to FIG. 8. All of the yellow development cartridge 5*a*, the magenta development cartridge 5*b*, the cyan development cartridge 5*c*, and the black development cartridge 5*d* are attached to the apparatus main body 100 in the same manner. Thus, here, it will be described, by way of example, how the yellow development cartridge 5*a* is attached to the apparatus main body.

As illustrated in FIG. 8, when the user grasps its grip 54, the yellow development cartridge 5*a* assumes an attitude akin to the attitude of the yellow development cartridge 5*a* when it is at the attachment/detachment position within the apparatus main body 100. This is because the grasping portion of the grip 54 is situated substantially vertically above the center of gravity G of the yellow development cartridge 5*a*. Further, the attachment operation indication label 59*d* of the black development cartridge 5*d* is attached to a portion visible from outside of the apparatus main body 100 when the user looks through the opening 30, with the attachment/detachment cover 13 provided in the apparatus main body 100 being open. When the user attaches the development cartridge 5*a* to the apparatus main body 100, the user brings the yellow development cartridge 5*a* close to the opening 30. In this state, the user can visually inspect both the yellow development cartridge 5*a* to be attached, and the attachment operation indication label 59 provided on the top surface of the black development cartridge 5*d* attached to the position adjacent to the attachment/detachment position.

When attaching the yellow development cartridge 5*a* to the apparatus main body 100, the user looks into the apparatus main body 100 through the opening 30 from outside of the apparatus main body 100. Then, the attachment operation indication label 59 attached to the black development cartridge 5*d* inevitably comes into view. Because of the attachment operation indication label 59 inevitably coming into view, the user can correctly attach the development cartridge. Further, there is no need to perform such a complicated operation as performing the attachment while reading a procedure manual indicating the attachment method in more detail than the attachment operation indication label 59, so that it is possible to relieve the burden on the user. By thus arranging the attachment operation indication label 59 in the attachment direction of the yellow development cartridge 5*a*, the user is enabled to correctly attach the yellow development cartridge 5*a*. Furthermore, it is possible to simultaneously view the development cartridge 5*a*, the opening 30 for insertion, and the attachment operation indication label 59, with the grasped yellow development cartridge 5*a* being close to the opening 30. Thus, through indication of the attachment operation as seen from the direction of the user's point of view, the operation at the time of attachment can be made easier to understand.

As describe above, according to the present exemplary embodiment, the attachment operation indication label 59 is provided on a surface which is other than the surface on the outer peripheral side in the rotary radial direction where the development roller, etc., are arranged and which is visible, through the opening 30, on the development cartridge adjacent to the development cartridge that has been removed from the rotary. As a result, it is possible to achieve a further reduction in the size of the development cartridge while maintaining the requisite operability when replacing the development cartridge.

An image forming apparatus according to a second exemplary embodiment of the present invention will be described. The portions that are the same as those of the above-described first exemplary embodiment are indicated by the same reference numerals, and a description of such portions will be omitted.

The operation of attaching the yellow development cartridge 5*a* to the apparatus main body 100 of the image forming apparatus will be described with reference to FIGS. 9 and 10.

Figure 9:
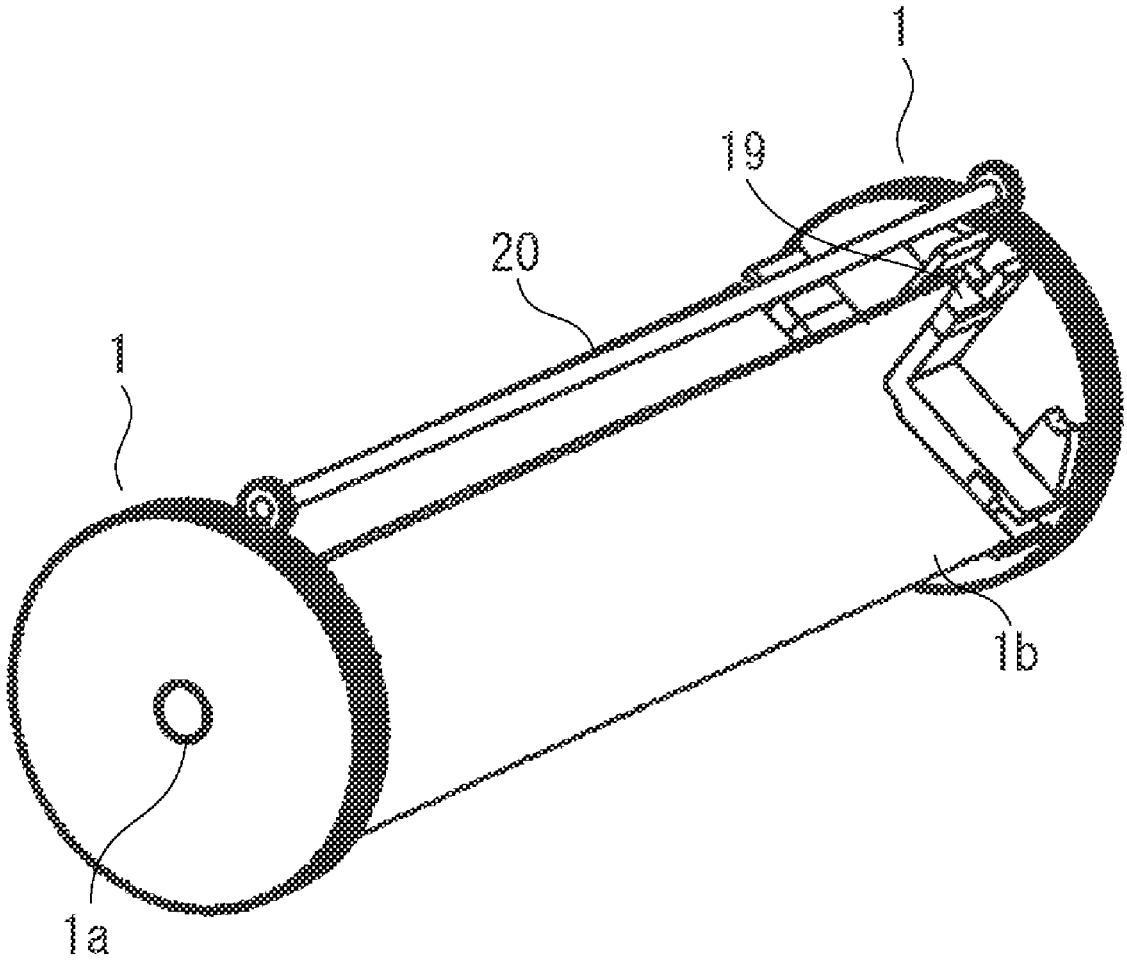
FIG. 9 is a perspective view of a rotary retaining development cartridges according to a second exemplary embodiment of the present invention.

FIG. 9 is a schematic perspective view of a rotary retaining development cartridge. FIG. 10 is a sectional view of the image forming apparatus main body, illustrating the attachment operation by the user when attaching the yellow development cartridge 5*a*.

As illustrated in FIG. 9, in the rotary 1 according to the present exemplary embodiment, the partition plate (partition portion) 1*b* is mounted so as to extend over the entire longitudinal development cartridge 5*a*. Otherwise, it is of the same construction as the first exemplary embodiment.

An attachment operation indication label (indicator) 60 indicating the development cartridge attachment method will be described with reference to FIGS. 9 and 10.

As illustrated in FIG. 9, the attachment operation indication label 60 of the development cartridge is attached to the side of the yellow development cartridge 5*a*, which is on the upstream side with respect to the rotary rotating direction, of the partition plate (partition portion) 1*b* between the yellow development cartridge (first development cartridge) 5*a* and the black development cartridge (second development cartridge) 5*d*. As illustrated in FIG. 10, in the state in which the rotary 1 has stopped its rotation at the attachment/detachment position of the yellow development cartridge 5*a* and in which the attachment/detachment cover 13 is open, the attachment operation indication label 60 attached to the partition plate 1*b* becomes visible from outside of the apparatus main body 100 through the opening 30 by removing the yellow development cartridge 5*a*.

Further, the position where the attachment operation indication label is attached is not restricted to the yellow development cartridge 5*a* side portion of the partition plate 1*b*, which is on the upstream side with respect to the rotary rotating direction. As illustrated in FIG. 10, any surface will do so long as visual inspection through the opening 30 is possible in the state in which the development cartridge has been removed. Further, it is also possible to attach attachment operation indication labels 60 to a plurality of surfaces satisfying the above-mentioned condition. Further, although in the present exemplary embodiment a label is attached to the partition plate 1*b* as the indicator, this should not be construed restrictively; it is also possible to directly inscribe the above-mentioned operation method on the partition plate 1*b* (inscription portion). In the case where a label is used, it is also possible to achieve an improvement in terms of recycling property by adopting label of the same material as the partition plate 1*b* and facilitating the separation of the label.

Next, the operation when the user actually attaches the development cartridge 5*a* to the apparatus main body 100 will be described with reference to FIG. 10. All of the yellow development cartridge 5*a*, the magenta development cartridge 5*b*, the cyan development cartridge 5*c*, and the black development cartridge 5*d* are attached to the apparatus main body 100 in the same manner. Thus, here, it will be described, by way of example, how the yellow development cartridge 5*a* is attached to apparatus main body.

Figure 10:
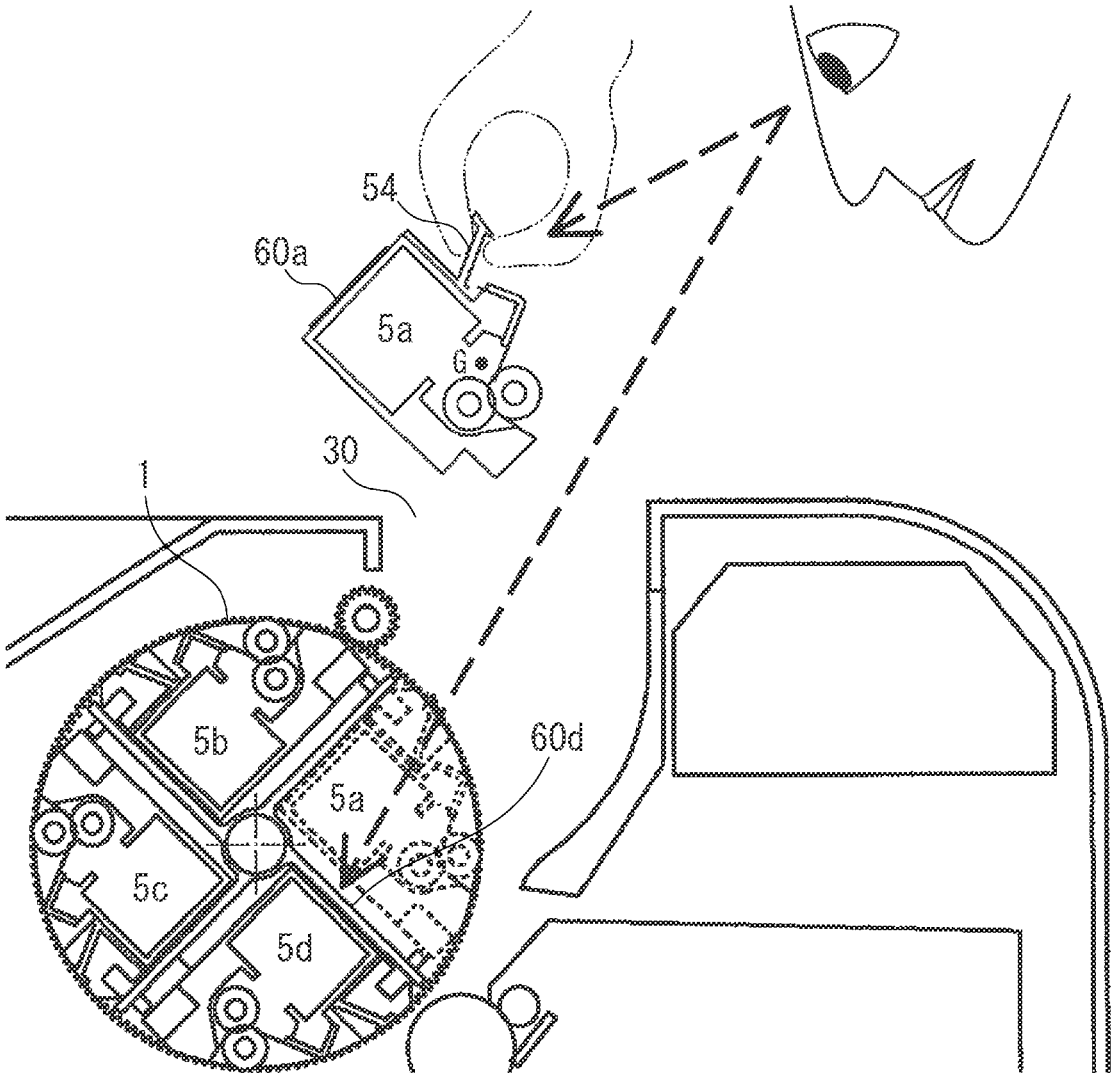
FIG. 10 is a sectional view of the image forming apparatus when the development cartridge according to the second exemplary embodiment is attached to the image forming apparatus main body.

As illustrated in FIG. 10, when the user grasps the grip 54, the attitude of the yellow development cartridge 5*a* is akin to the attitude of the yellow development cartridge 5*a* at the attachment/detachment position in the apparatus main body 100. This is because the grasping portion of the grip 54 is situated substantially vertically above the center of gravity G of the yellow development cartridge 5*a*. Further, the attachment operation indication label 60 attached to the partition plate 1*b* is attached to a position where it is visible from outside of the apparatus main body 100 when the user looks through the opening 30, with the attachment/detachment cover 13 provided in the apparatus main body 100 being open. When the user attaches the development cartridge 5*a* to the apparatus main body 100, the user brings the yellow development cartridge 5*a* close to the opening 31. In this state, the user can visually inspect both the yellow development cartridge 5*a* to be attached and the attachment operation indication label 60 attached to the partition plate 1*b*.

When attaching the yellow development cartridge 5*a* to the apparatus main body 100, the user looks into the apparatus main body 100 through the opening 30 from outside of the apparatus main body 100. Then, the development cartridge attachment operation indication label 60 attached to the partition plate 1*b* inevitably comes into view. Because of the attachment operation indication label 60 inevitably coming into view, the user can correctly attach the development cartridge. Further, there is no need to perform such a complicated operation as performing the attachment while reading a procedure manual indicating the attachment method in more detail than the attachment operation indication label 60, so that it is possible to relieve the burden on the user. By thus arranging the attachment operation indication label 60 in the attachment direction of the yellow development cartridge 5*a*, the user is enabled to correctly attach the yellow development cartridge 5*a*. Furthermore, it is possible to simultaneously view the development cartridge 5*a*, the opening 30 for insertion, and the attachment operation indication label 60, with the grasped yellow development cartridge 5*a* being close to the opening 30. Thus, through indication of the attachment operation as seen from the direction of the user's point of view, the operation at the time of attachment can be made easier to understand.

As described above, according to the present exemplary embodiment, the attachment operation indication label 60 is provided on the surface of the partition plate 1*b* of the rotary 1 visible from the opening 30, with the development cartridge removed from the rotary 1. As a result, it is possible to realize a further reduction in size of the development cartridge while maintaining the requisite operability at the time of replacement of the development cartridge.

Although in the exemplary embodiments described above the attachment operation indication label is provided on the top surface (flat surface) of the development cartridge, the configuration of the development cartridge is not restricted to the above-described one. For example, the present invention is effective even if it is applied to a columnar development cartridge. In this case, the attachment operation indication label is provided in a region which is other than the outer peripheral side in the rotary radial direction where the development roller, etc., are arranged and which is visible from the opening. Further, of the surface (region) visible from the opening, it may be attached to any region of the development cartridge attached to the rotary and adjacent to the development cartridge that has been removed from the rotary. As a result, as in the above-described exemplary embodiments, it is possible to realize a further reduction in size of the development cartridge while maintaining the requisite operability at the time of replacement of the development cartridge.

Further, although there are used four detachable development cartridges in the above-described exemplary embodiments, the number of development cartridges is not restricted to four, but can be set to any other number as appropriate.

Further, in the above-described exemplary embodiments, there is used, as a process cartridge detachable with respect to an image forming apparatus main body, a process cartridge integrally having a photosensitive drum, a charging unit as a process unit acting on the photosensitive drum, and a cleaning unit. However, this should not be construed restrictively; it is also possible to adopt a process cartridge integrally having, apart from the photosensitive drum, one of a charging unit and a cleaning unit.

Further, in the above-described embodiments, the image forming apparatus is a printer, which, however, should not be construed restrictively. It may also be some other type of image forming apparatus, such as a copying machine or a facsimile apparatus, or a multifunction peripheral in which the function of these apparatuses are combined. Further, it may also be an image forming apparatus which uses a recording medium bearing member and in which toner images of different colors are successively superimposed one upon the other on a recording medium borne by the recording medium bearing member. By applying the present invention to such an image forming apparatus, it is possible to attain the same effect as mentioned above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-249748 filed Oct. 30, 2009, which is hereby incorporated by reference herein in its entirety.

What is claimed is:

1. An image forming apparatus comprising:

an image bearing member on which is formed an electrostatic image;

a plurality of development cartridges each including a developer bearing member configured to bear a developer for developing the electrostatic image and a developer container configured to accommodate the developer;

a rotary, to which the plurality of development cartridges are detachably attached, configured to rotate and move the attached development cartridges toward a development position where the electrostatic image is developed;

an opening defined in a main body of the image forming apparatus and allowing the development cartridge to pass therethrough for attachment and detachment to and from the rotary; and an indicator provided on a second development cartridge arranged adjacent to a first development cartridge passing through the opening and detached from the rotary being stopped, wherein the indicator indicates an attachment method, an attachment procedure, or a handling method usable to attach the first development cartridge to the rotary, and wherein the indicator is located at such a position on the second development cartridge as to be visible from outside of the main body via the opening with the first development cartridge detached.

2. The image forming apparatus according to claim 1, wherein, when the rotary is stopped, the indicator is located at such a position that a normal with respect to the indicator is directed to the opening.

3. The image forming apparatus according to claim 1, wherein the indicator is provided on a surface of the second development cartridge opposite to the first development cartridge.

4. The image forming apparatus according to claim 1, wherein the indicator includes an inscription portion formed on the developer container or a label attached to the developer container.

5. An image forming apparatus comprising:

an image bearing member on which is formed an electrostatic image;

a plurality of development cartridges each including a developer bearing member configured to bear a developer for developing the electrostatic image and a developer container configured to accommodate the developer;

a rotary, to which the plurality of development cartridges are detachably attached, configured to rotate and move the attached development cartridges toward a development position where the electrostatic image is developed;

a partition portion provided on the rotary and arranged between the plurality of development cartridges attached to the rotary;

an opening defined in a main body of the image forming apparatus and allowing the development cartridge to pass therethrough for attachment and detachment to and from the rotary; and an indicator provided on the partition portion arranged adjacent to a first development cartridge passing through the opening and detached from the rotary being stopped, wherein the indicator indicates an attachment method, an attachment procedure, or a handling method usable to attach the first development cartridge to the rotary, and wherein the indicator is located at such a position on the partition portion as to be visible from outside of the main body via the opening with the first development cartridge detached.

6. The image forming apparatus according to claim 5, wherein, when the rotary is stopped, the indicator is located at such a position that a normal with respect to the indicator is directed to the opening.

7. The image forming apparatus according to claim 5, wherein the indicator includes an inscription portion formed on the partition portion or a label attached to the partition portion.

8. A development cartridge detachable with respect to an image forming apparatus including an image bearing member on which is formed an electrostatic image, a rotary, to which a plurality of development cartridges for developing the electrostatic image are detachably attached, configured to rotate and move the attached development cartridges toward a development position where the electrostatic image is developed, and an opening defined in a main body of the image forming apparatus and configured to allow the development cartridge to pass therethrough for attachment and detachment to and from the rotary, the development cartridge comprising:

a developer bearing member configured to bear a developer for developing the electrostatic image;

a developer container configured to accommodate the developer; and an indicator provided on a second development cartridge arranged adjacent to a first development cartridge passing through the opening and detached from the rotary being stopped, wherein the indicator indicates an attachment method, an attachment procedure, or a handling method usable to attach the first development cartridge to the rotary, and wherein the indicator is located at such a position on the second development cartridge as to be visible from outside of the main body via the opening with the first development cartridge detached.

9. The development cartridge according to claim 8, wherein, when the rotary is stopped, the indicator is located at such a position that a normal with respect to the indicator is directed to the opening.

10. The development cartridge according to claim 8, wherein the indicator is provided on a surface of the second development cartridge opposite to the first development cartridge.

11. The development cartridge according to claim 8, wherein the indicator includes an inscription portion formed on the developer container or a label attached to the developer container.

* * * * *